US005658384A

United States Patent [19]

Imlay, Jr.

[11] Patent Number: 5,658,384

[45] Date of Patent: Aug. 19, 1997

[54] APPLICATOR TOOL FOR DELIVERY OF ADHESIVE MATERIAL

[76] Inventor: Charles T. Imlay, Jr., 1435 NW. 131st Ave., Portland, Oreg. 97229

[21] Appl. No.: 505,770

[22] Filed: Jul. 24, 1995

[51] Int. Cl.[6] ..... B05C 1/00; A47L 13/26; A46B 11/00

[52] U.S. Cl. ..... 118/200; 401/139; 401/123; 401/266

[58] Field of Search ..... 401/118, 119, 401/120, 128, 126, 191, 266, 139, 123; 118/200

[56] References Cited

U.S. PATENT DOCUMENTS 4,850,727 7/1989 Gueret ..... 401/126

*Primary Examiner*—Donald E. Czaja

*Assistant Examiner*—Calvin Padgett

*Attorney, Agent, or Firm*—Smith-Hill and Bedell

[57] ABSTRACT

An applicator tool for manual delivery of a controlled quantity of a liquid to an application site, comprises a handle and a tool bit attached to the handle. The tool bit comprises a plate made of a material that is not readily wetted by the liquid. The plate has an attachment portion by which the plate is attached to the handle, and two fingers that extend from the attachment portion toward a tip of the tool bit and are separated by a slot.

16 Claims, 1 Drawing Sheet

APPLICATOR TOOL FOR DELIVERY OF ADHESIVE MATERIAL

BACKGROUND OF THE INVENTION

This invention relates to an applicator tool for manual delivery of a controlled quantity of a selected adhesive material to an application site.

In construction of models, such as model aircraft and ships made from wood and plastic, it is common to employ a cyanoacrylate (CA) adhesive for bonding the components of the model. CA adhesive is favorable for this purpose, because when it is of low viscosity, its surface tension causes the adhesive to wick readily between two components that are held close together.

CA adhesive is usually sold in small bottles with a dispensing nozzle, but the dispensing nozzle is rather thick and may only be about 3 cm long, so that interference from components that have previously been assembled renders it difficult to position the tip of the nozzle sufficiently close to the location at which a joint is desired for the drop of adhesive to span the joint so that the adhesive will wick between the two components. Further, it is virtually impossible to control the size of the drop sufficiently precisely to ensure that enough adhesive is delivered to secure the components without forming an objectionable fillet. Moreover, the material of the nozzle is such that any adhesive that drips down the exterior of the nozzle and becomes cured adheres strongly to the nozzle so that it is very difficult to remove. Consequently, the nozzle becomes thickened and the difficulty of placing the tip of the nozzle at the desired location is exacerbated.

The problem of accurately delivering a liquid to an application site arises not only with adhesives but also with other liquids, such as paints and lubricating oils. It is conventional to use a brush to apply paint to a solid object. When a brush is used, there is a danger that a bristle will become detached from the brush and mar the painted surface. A dropper, comprising a nozzle with a suction bulb attached, may be used to deliver lubricating oil to an application site, but frequently the smallest drop that can be deposited using a dropper is much larger than is necessary to accomplish the intended purpose.

SUMMARY OF THE INVENTION

In accordance with a first aspect of the invention there is provided an applicator tool for manual delivery of a controlled quantity of a selected liquid to an application site, comprising a handle, and a tool bit attached to the handle, the tool bit comprising a plate-form member made of a material that is not readily wetted by the selected liquid, the plate-form member having an attachment portion by which the plate-form member is attached to the handle, and two fingers that extend from the attachment portion toward a tip of the tool bit and are separated by a slot.

In accordance with a second aspect of the invention there is provided apparatus for manual delivery of a selected liquid to an application site, comprising a well defining a cavity for receiving a pool of the selected liquid material, and an applicator tool for removing a controlled quantity of the selected liquid material from the well and delivering it to the application site, the applicator tool comprising a handle, and a tool bit attached to the handle, the tool bit comprising a plate-form member made of a material that is not readily wetted by the selected liquid, the plate-form member having an attachment portion by which the plate-form member is attached to the handle, and two fingers that extend from the attachment portion toward a tip of the tool bit and are separated by a slot, and wherein the size of the cavity defined by the well is such that the fingers of the tool bit can be fully immersed in a pool of liquid in the cavity.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
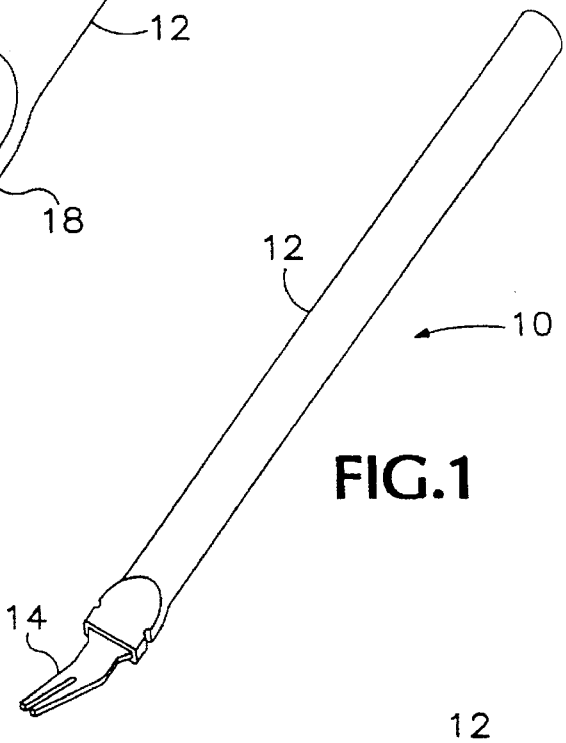
FIG. 1 is a perspective view of an applicator tool embodying the present invention.

The applicator tool 10 that is shown in FIG. 1 comprises a handle 12 and a tool bit 14. The handle 12 is long and slender and may be formed of metal tube. The tool bit 14 is made from a synthetic polymer material that is elastically flexible and is not readily wettable by the adhesive that is to be applied. In the case of the adhesive being a low or medium viscosity CA adhesive, the preferred material for the tool bit is the molybdenum disulfide type 6/6 nylon sold by Polymer Corporation under the designation NYLATRON-GS, and is about 0.7 mm thick. This material, which is conventionally used for making washers, is supplied in sheet form, and the tool bit is cut from the sheet form material.

Figure 3:
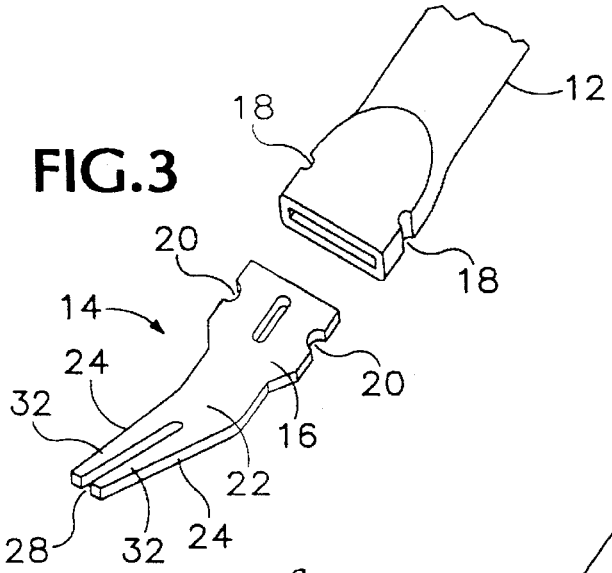
FIG. 3 is similar to FIG. 2 but shows the tool bit removed from the handle.
Figure 2:
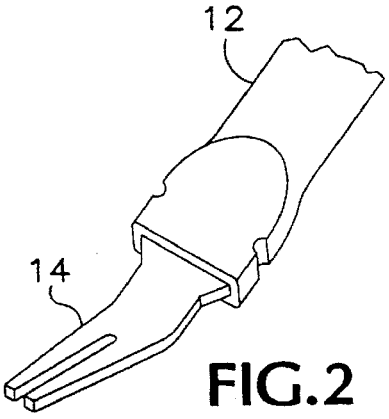
FIG. 2 is a partial enlarged view of one end of the tool, showing a handle and a tool bit.

It will be seen from FIGS. 1–3 that there is a slight bend in the tool bit. The preferred sheet material lies flat when in an unstressed condition, and the bend in the tool bit is formed by applying a bending stress that exceeds the elastic yield point of the material, so that the tool bit accepts a permanent bend.

Referring to FIG. 3, the tool bit 14 has a generally rectangular rear portion 16 for attachment to the handle 12. One way the attachment may be accomplished is by partially flattening one end of the handle to distort the opening from a circular form to an extended oblong form and inserting the attachment portion 16 of the tool bit into the opening. The flattened part of the tube may be crimped at its edges, as shown at 18, to form detents that project into the opening.

The attachment portion 16 of the tool bit fits snugly into the oblong opening and has two notches 20 at its two opposite edges. When the tool bit is fitted to the handle, the two detents 18 snap into the two notches 20 respectively, and hold the tool bit securely to the handle. Engagement of the detents in the notches serves to stabilize the tool bit relative to the handle yet allows ready removal and replacement of the tool bit.

Forward of the attachment portion, the tool bit tapers to an applicator portion 22.

The applicator portion 22 has two edges 24 that converge toward a tip. A slot 28 that opens at the tip of the applicator portion divides the tip into two fingers 32. The width of the slot depends on the properties of the adhesive, and it has been found that in the case of a low to medium viscosity CA adhesive, a width of approximately 0.5 mm is satisfactory.

Figure 1A:
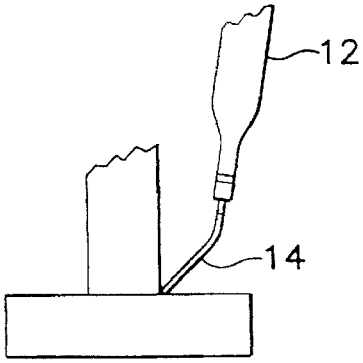
FIG. 1A illustrates use of the tool to deliver adhesive to two components that are to be bonded together.
Figure 6:
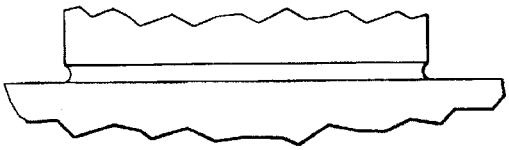
FIG. 6 is an enlarged view of the components shown in FIG. 1A.
Figure 4:
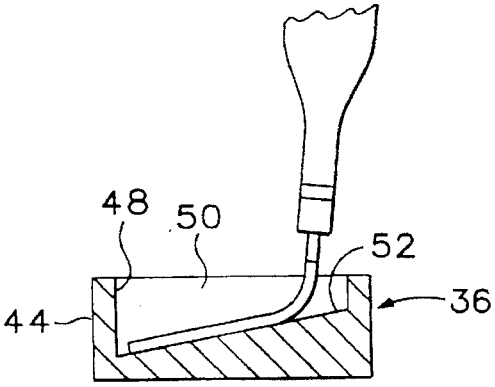
FIG. 4 illustrates a well used for charging the tool bit with liquid adhesive.

FIG. 4 shows a well 36 that is used to charge the tool bit with liquid adhesive. The well 36 is designed to be placed on a horizontal surface and has a flat base 40 from which a peripheral wall 44 extends upwardly to surround a cavity 48. A pool 50 of liquid adhesive is placed in the cavity 48. The cavity 48 is bounded by a floor 52 that is inclined relative to the base 40, so that when the well rests on a horizontal surface, the pool 50 is deeper at one end than at the other. The cavity is slightly wider than the maximum width of the tool bit and is slightly longer than the applicator portion thereof so as to minimize the free surface area of the pool. This configuration, in conjunction with the bend in the tool bit and the flexibility of the tool bit, allows the applicator portion of the tool bit to be immersed fully in the pool of CA adhesive, as shown in FIG. 4, while the handle extends almost vertically upward. When the tool bit is lifted from the pool of adhesive, the adhesive beads and runs off the tool bit due to its being repelled by the material of the tool bit, except that a small drop of adhesive remains in the slot between the two fingers. Also, the bend in the tool bit returns to the configuration shown in FIGS. 1–3. The tool bit is then positioned so that the tip of the applicator portion touches the components to be joined, across the space therebetween, as shown in FIG. 1A, and the liquid adhesive is displaced from the slot and bridges the narrow gap between the components that are to be joined. Surface tension effects pull the adhesive from the tool bit into the gap between the components as shown in FIG. 6. If any adhesive remains on the tool bit, it can readily be removed using a cloth or facial tissue.

In addition to aiding immersion of the applicator portion in the pool of adhesive, the bend in the tool bit ensures that the tip of the tool bit can be viewed along the handle. This is desirable when it is necessary to deliver adhesive to a location to which sight lines are restricted.

Figure 5:
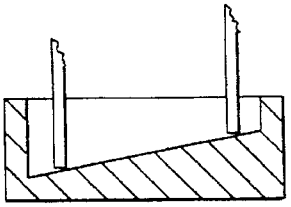
FIG. 5 shows use of the well for selective charging of the tool bit.

In the event that it is not necessary to fill the entire slot of the tool bit with adhesive, the tool bit is presented to the pool of adhesive with the fingers pointing vertically downward as shown in FIG. 5. The surface tension is not sufficient to fill the slot, so the quantity of adhesive is then dependent on the depth to which the fingers are immersed. By selecting the location at which the fingers are immersed, having regard to the sloping floor 52 of the well, the size of the drop of adhesive is controllable.

Even though CA adhesive cures very rapidly when applied in a thin film, it has been found that when the adhesive is placed in a well as described with reference to FIG. 4, having a rather small surface area relative to its volume, the adhesive remains usable for an extended period of time. In particular instances, the adhesive has remained usable for over 24 hours.

The adhesive may be supplied in single-use packages, comprising a ready-filled well 44 with a flexible peel-off cover attached to the well around the top of the wall 44. The occasional user need only buy a small quantity of adhesive, or can buy a larger quantity in sealed packages that protect their contents from deterioration. If the cover is replaced while some adhesive remains unused, the adhesive will remain in usable condition for an extended period of time, but even if it is no longer usable, very little adhesive is wasted.

The applicator tool facilitates use of CA adhesive in household repairs, such as re-attaching a handle to a cup. If the handle is held in position using rubber bands, it can be tacked to the cup by applying two or three small drops of adhesive around the periphery of each break. The handle is then fairly secure, so that the bands can be removed and a larger quantity of adhesive can be delivered to form a continuous bond between the two objects.

It will be appreciated that the invention is not restricted to the particular embodiment that has been described, and that variations may be made therein without departing from the scope of the invention as defined in the appended claims and equivalents thereof. The invention is not restricted to use in model building. For example, it has been proposed that CA adhesive should be used in lieu of other attachment mechanisms in some surgical applications, and the invention may be applied to a tool for delivering adhesive in a surgical application. In the case in which the adhesive is to be applied to soft tissue, the tool bit would generally be softer and more pliable than in the case in which adhesive is to be applied to bone or cartilage. The invention is not restricted to use with cyanoacrylate adhesives, since other liquid adhesives having similar viscosity and surface tension may be used instead. For example, a tool similar to that shown in FIG. 1 has been successfully used for delivering a controlled quantity of the adhesive material sold by Borden, Inc. under the designation ELMER'S GLUE ALL. It will, of course, be appreciated that in certain applications it is not so important that the tool bit not be wettable by the adhesive, because the adhesive does not bond securely to the tool bit and can be easily chipped or flaked therefrom. A tool similar to that shown in FIG. 1 may be used for delivering paint to a desired application site. This allows very close control over application of paint and is desirable in model building. When the tool is used for applying paint to a solid body, control over the boundary of the painted area can be achieved by use of masking tape. In this case, the masking tape serves as a guide against which the edge of the tool bit is run, rather than as a mask to prevent paint being applied to areas outside the desired boundary. The invention is not restricted to the tool bit having only two fingers separated by one slot. The tool bit may comprise three or more fingers, with a slot between each two adjacent fingers. This enables liquid to be applied over a wide strip, and is particularly suitable for applying paint. It has been found that the applicator tool is not limited to use where the application site is below the tool, and that capillary action will draw the adhesive upward from the tool bit against the force of gravity.

I claim:

1. Apparatus for manual delivery of a selected liquid to an application site, comprising:

a well defining a cavity for receiving a pool of the selected liquid material, and an applicator tool for removing a controlled quantity of the selected liquid material from the well and delivering it to the application site, the applicator tool comprising a handle, and a tool bit attached to the handle, the tool bit comprising a plate-form member made of a material that is not readily wetted by the selected liquid, the plate-form member having an attachment portion by which the plate-form member is attached to the handle, and two fingers that extend from the attachment portion toward a tip of the tool bit and are separated by a slot, and wherein the size of the cavity defined by the well is such that the fingers of the tool bit can be fully immersed in a pool of liquid in the cavity.

2. Apparatus according to claim 1, wherein the well has a substantially flat bottom surface and the cavity has a substantially flat floor that is inclined relative to the bottom surface of the well, whereby depth of a pool of liquid in the cavity is non-uniform.

3. An applicator tool for manual delivery of a controlled quantity of a selected liquid to an application site, comprising:

a handle, and a tool bit attached to the handle, the tool bit comprising a plate-form member made of a material that is not readily wetted by the selected liquid, the plate-form member having an attachment portion by which the plate-form member is attached to the handle, and two fingers that extend from the attachment portion toward a tip of the tool bit and are separated by a slot.

4. A tool according to claim 3, wherein each finger is defined between the slot and an edge of the tool bit, and the two edges converge toward the tip of the tool bit.

5. A tool according to claim 3, for delivery of an adhesive material, wherein the material of the plate-form member is such that the adhesive material does not adhere readily to the plate-form member.

6. A tool according to claim 3, for delivery of cyanoacrylate adhesive, wherein the material of the plate-form member comprises a nylon material.

7. A tool according to claim 3, for delivery of cyanoacrylate adhesive, wherein the material of the plate-form member is a nylon material filled with molybdenum disulfide.

8. Apparatus according to claim 1, wherein the plate form member has two opposite substantially flat surfaces and the slot is open over its entire length at both surfaces.

9. A tool according to claim 3, wherein the plate form member has two opposite substantially flat surfaces and the slot is open over its entire length at both surfaces.

10. An applicator tool for manual delivery of a controlled quantity of a selected liquid to an application site, comprising:

a handle, and a tool bit attached to the handle, the tool bit comprising a plate-form member having two substantially flat opposite surfaces and made of a material that is not readily wetted by the selected liquid, the plate-form member including an attachment portion by which the plate-form member is attached to the handle and also including an applicator portion that projects from the handle, the applicator portion having two fingers that extend from the attachment portion toward a tip of the tool bit and are separated by a slot that is open at both surfaces of the plate-form member over entire length of the applicator portion.

11. A tool according to claim 10, wherein each finger is defined between the slot and an edge of the tool bit, and the two edges converge toward the tip of the tool bit.

12. A tool according to claim 10, for delivery of an adhesive material, wherein the material of the plate-form member is such that the adhesive material does not adhere readily to the plate-form member.

13. A tool according to claim 10, for delivery of cyanoacrylate adhesive, wherein the material of the plate-form member comprises a nylon material.

14. A tool according to claim 10, for delivery of cyanoacrylate adhesive, wherein the material of the plate-form member is a nylon material filled with molybdenum disulfide.

15. A tool according to claim 10, in combination with a well defining a cavity for receiving a pool of the selected liquid material, and wherein the size of the cavity defined by the well is such that the fingers of the tool bit can be fully immersed in a pool of liquid in the cavity.

16. A tool according to claim 15, wherein the well has a substantially flat bottom surface and the cavity has a substantially flat floor that is inclined relative to the bottom surface of the well, whereby depth of a pool of liquid in the cavity is non-uniform.

* * * * *